US006116860A

United States Patent [19]

Miura et al.

[11] Patent Number: 6,116,860

[45] Date of Patent: Sep. 12, 2000

[54] SCROLL COMPRESSOR

[75] Inventors: Shigeki Miura; Kimiharu Takeda, both of Nishi-kasugai-gun, Japan

[73] Assignee: Mitsubishi Heavy Industries, Ltd., Tokyo, Japan

[21] Appl. No.: 09/138,514

[22] Filed: Aug. 24, 1998

[30] Foreign Application Priority Data

Sep. 8, 1997 [JP] Japan ..... 9-257982

[51] Int. Cl.[7] ..... F04B 49/00

[52] U.S. Cl. ..... 417/310; 417/307

[58] Field of Search ..... 62/505; 417/307, 417/32, 310; 418/55.1, 88, 55.6, 55.3

[56] References Cited

U.S. PATENT DOCUMENTS

| | | | |
|---|---|---|---|
| 5,362,210 | 11/1994 | Richardson | 417/307 |
| 5,503,542 | 4/1996 | Grassbaugh et al. | 418/55.1 |
| 5,593,297 | 1/1997 | Nakajima et al. | 418/88 |
| 5,690,475 | 11/1997 | Yamada | 417/32 |
| 5,722,257 | 3/1998 | Ishii et al. | 62/505 |
| 5,772,416 | 6/1998 | Cailatt et al. | 418/55.6 |
| 5,803,716 | 9/1998 | Wallis et al. | 417/310 |
| 5,810,573 | 9/1998 | Mitsunaga et al. | 418/55.6 |
| 5,897,306 | 4/1999 | Beck | 418/55.3 |

*Primary Examiner*—Teresa Walberg
*Assistant Examiner*—Leonid Fastovsky
*Attorney, Agent, or Firm*—Oblon, Spivak, McClelland, Maier & Neustadt, P.C.

[57] ABSTRACT

A scroll compressor including a closed housing, a fixed scroll disposed in the closed housing, and a swirling scroll disposed in the closed housing, which meshes with the fixed scroll and moves in a swirling motion. The scroll compressor further including a compression chamber formed by the meshing of the fixed scroll and the swirling scroll, a suction chamber connected to the compression chamber, a discharge cavity connected to the compression chamber, and a partition separating the discharge cavity from the suction chamber. The scroll compressor includes an exhaust valve provided between the compression chamber and discharge cavity, a retainer for regulating the head of the exhaust valve, and a pressure relief valve attached to and extending through the partition, while anchoring the exhaust valve and retainer to the partition.

2 Claims, 3 Drawing Sheets

1;CLOSED HOUSING
10;FIXED SCROLL
11;END PLATE(PARTITION)
14;SWIRLING SCROLL
19a, 19B;COMPRESSION CHAMBER
28;SUCTION CHAMBER
31;DISCHARGE CAVITY
30;EXHAUST VALVE
32;RETAINER
50;PRESSURE RELIEF VALVE

SCROLL COMPRESSOR

BACKGROUND OF THE INVENTION

1. Field of the Invention

The present invention relates to a scroll compressor used to compress refrigerant gas of a refrigerator for an air conditioning device. The present application is based on Japanese Patent Application No. Hei 9-257982, the contents of which are herein incorporated by reference.

2. Description of the Related Art

A vertical cross section of a conventional scroll compressor is shown in FIG. 3.

In FIG. 3, a cup-shaped housing 2 and a front housing 6 form a closed housing 1, and within this closed housing 1, a fixed scroll 10 and a swirling scroll 14 are disposed. The swirling scroll 14 produces a revolution swirling motion while meshing with the fixed scroll 10.

The fixed scroll 10 is provided with an end plate 11 and a spiral wrap 12 projecting from the inner surface thereof, and the end plate 11 is fastened to the cup-shaped body 2 by a bolt(not shown).

A space within the closed housing 1 is separated by bringing the outer peripheral surface of the end plate 11 into contact with the inner peripheral surface of the cup-shaped body 2, so that a discharge cavity 31 is formed by the outer side of the end plate 11 and a suction chamber 28 is formed by the inner side of the end plate 11.

In the above-described conventional scroll compressor, a pressure relief valve 60 is mounted on the cup-shaped housing 2, and when the pressure of the refrigerant gas in the discharge cavity 31 rises abnormally, this pressure relief valve 60 opens, expels this gas out of the closed housing 1. Therefore, when the pressure of the refrigerant gas in the discharge cavity 31 rises abnormally and this relief valve 60 opens, the performance of the refrigerating apparatus subsequently deteriorates if the refrigerant gas is not supplied to the refrigerant gas circuit.

SUMMARY OF THE INVENTION

In consideration of the above, the present invention provides a scroll compressor which can maintain performance of a refrigeration apparatus such as an air conditioner, without resupplying refrigerant gas to the refrigeration circuit even after refrigerant gas is discharged from the discharge cavity 31 when the pressure of the refrigerant gas rises abnormally in the discharge cavity 31.

In order to solve the above problem, the scroll compressor of the present invention comprises a closed housing, a fixed scroll disposed in the closed housing; a swirling scroll disposed in the closed housing, meshing with the fixed scroll, and moving in a swirling motion; a compression chamber formed by the meshing of the fixed scroll and the swirling scroll; a suction chamber connected to the compression chamber; an discharge cavity connected to the compression chamber; a partition separating the discharge cavity and the suction chamber; an exhaust valve provided between said compression chamber and discharge cavity; a retainer for regulating the head of the exhaust valve; and a pressure relief valve installed extending through the partition and anchoring the exhaust valve and the retainer to the partition.

According to the scroll compressor of the present invention, the pressure relief valve installed the partition that separates the discharge cavity and the suction chamber, when the pressure of the refrigerant gas in the discharge chamber rises abnormally, this pressure relief valve opens and can discharge the refrigerant gas inside the discharge chamber into the suction chamber.

Because the suction chamber resides within the closed housing, it is not necessary to supply new refrigerant gas when this discharge occurs.

Because the exhaust valve and the retainer for regulating the head of the exhaust valve are anchored to the end plate of the fixed scroll by the pressure relief valve, the bolt conventionally used to fasten the exhaust valve and the retainer is unnecessary, reducing the cost.

DETAILED DESCRIPTION OF THE EMBODIMENT

The present invention will be described below on the basis of an embodiment

Figure 1:
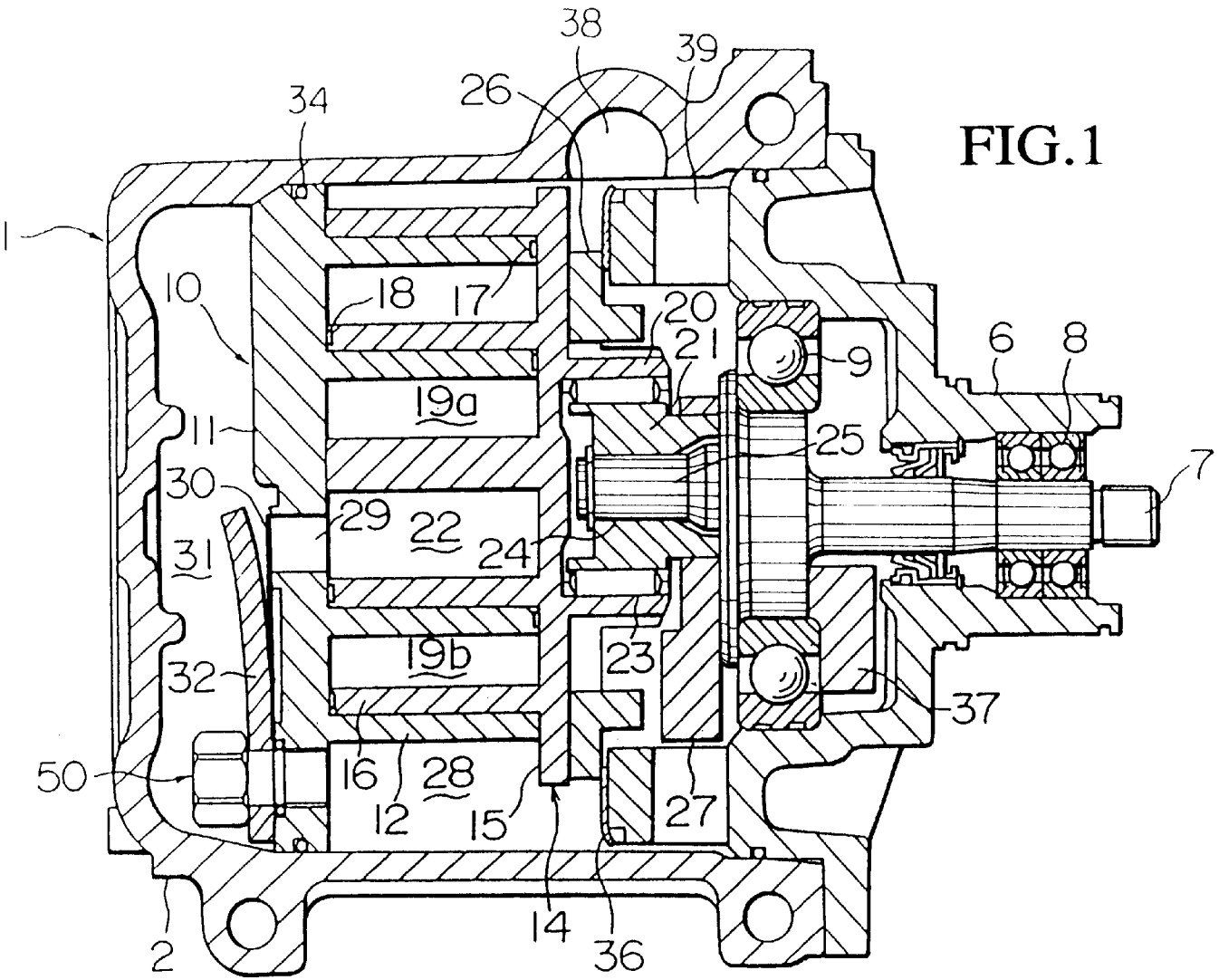
FIG. 1 is a vertical-cross section view which shows a scroll compressor according to an embodiment of the present invention.

FIG. 1 is a vertical cross-sectional view of a scroll compressor according to an embodiment of the present invention.

In FIG. 1, reference numeral 1 denotes a closed housing comprising a cup-shaped body 2 and a front housing 6 attached to the cup-shaped body 2 by a bolt (not shown). The rotating shaft 7 extending through the front housing 6 is supported so that it rotates freely in the front housing 6 via the bearings 8, 9.

A fixed scroll 10 and a swirling scroll 14 are disposed in the closed housing 1. The fixed scroll 10 is provided with an end plate 11 and a spiral wrap 12 projecting from the inner surface thereof, and the end plate 11 is fastened to the cup-shaped body 2 by a bolt(not shown).

A space within the closed housing 1 is delimited by bringing the '0' ring 34 of the outer peripheral surface of the end plate 11 into contact with an inner peripheral surface of the cup-shaped body 2, so that a discharge cavity 31 is formed in the outer side of the end plate 11 and a suction chamber 28 is formed in the inner side of the end plate 11. This end plate 11 is a partition of the present invention.

Further, a discharge port 29 penetrates the center of the end plate 11, and the discharge port 29 is structured in such a manner as to be opened and closed by a exaust valve 30. The head of the exaust valve 30 is regulated by the retainer 32, and one end of the exhaust valve 30 and the retainer 32 is attached to the end plate 11 by a pressure relief valve 50. A detailed description of the pressure relief valve 50 will be given below.

The swirling scroll 14 is provided with an end plate 15 and a spiral wrap 16 projecting from the inner surface thereof, the spiral wrap 16 having substantially the same shape as that of the spiral wrap 12 of the fixed scroll 10. The swirling scroll 14 and the fixed scroll 10 mesh with each other eccentrically at a fixed distance, and are shifted only 180°.

A tip seal 17 mounted in the front end surface of the spiral wrap 12 is in close contact with the inner surface of the end plate 15, and a tip seal 18 mounted in a front end surface of the spiral wrap 16 is in close contact with the inner surface of the end plate 11, so that the side surfaces of the spiral wrap 12 and 16 are in line contact at a plurality of locations, whereby a plurality of compressing chambers 19*a* and 19*b* are formed in point symmetry with respect to the center of the spiral.

A drive bush 21 rotatably engages the inner part of a cylindrical boss 20 projecting from the center part of the outer surface of the end plate 15 via a swirling bearing 23, and an eccentric drive pin 25 projecting from the inner end of the rotating shaft 7 engaged so as to freely slide in a slide groove 24 penetrating the drive bush 21.

A balance weight 27 for balancing a dynamic imbalance due to the revolution swirling motion of the swirling scroll 14 is mounted to the drive bush 21, and a balance weight 37 is mounted to the rotating shaft 7.

In addition, a rotation stopping mechanism comprising a thrust bearing 36 and an Oldham ring 26 is interposed between the peripheral edge of the outer surface of the end plate 15 of the swirling scroll 14 and the inner end surface of the front housing 6.

When the rotating shaft 7 is caused to rotate, the swirling scroll 14 is driven via a swirling activation mechanism comprising an eccentric drive pin 25, a slide groove 24, a drive bush 21, a swirling bearing 23, and a boss 20, and the swirling scroll 14 travels in a revolution swirling motion on a circular path whose radius is the revolution swirling radius. Otherwise, its free rotation is prevented by the Oldham ring 26.

The side surfaces of the spiral wraps 12 and 16 in line contact gradually move towards the center of the spiral, and as a result, the compression chambers 19*a* and 19*b* move in the direction of the center of the spiral, while reducing the volume thereof.

At the same time, the refrigerant gas flowing into the suction chamber 28 through suction port 38 and suction path 39 is introduced into the respective compression chambers 19*a*, 19*b* from the outer end opening of the spiral wraps 12, 16, is fed to the center chamber 22 under pressure. From there it passes though exhaust port 29, and pushing open the exhaust valve 30, is discharged into discharge cavity 31, and next flows out through a discharge pipe (not shown)to circulate through the refrigerant circuit comprising the condenser, expansion valve, and evaporator.

The pressure relief valve 50 anchors the exhaust valve 30 and the retainer 32 by extending through the end plate 11 of the fixed scroll 10.

Figure 2:
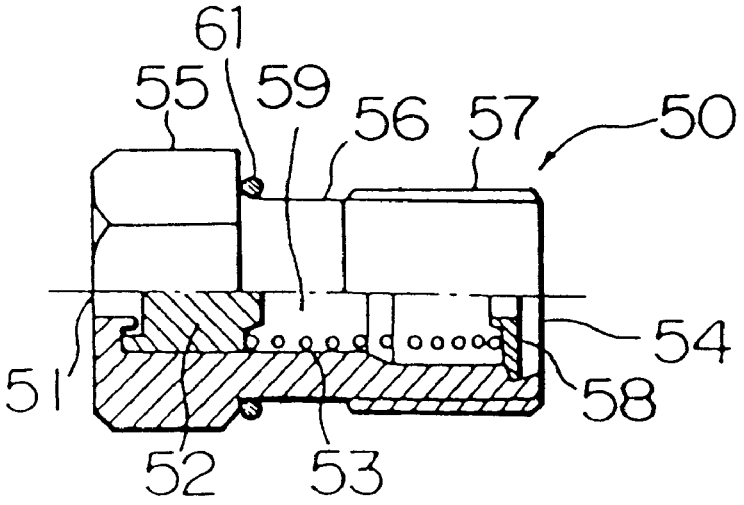
FIG. 2 is a vertical-cross section view which shows a pressure relief valve comprising the embodiment.
Figure 3:
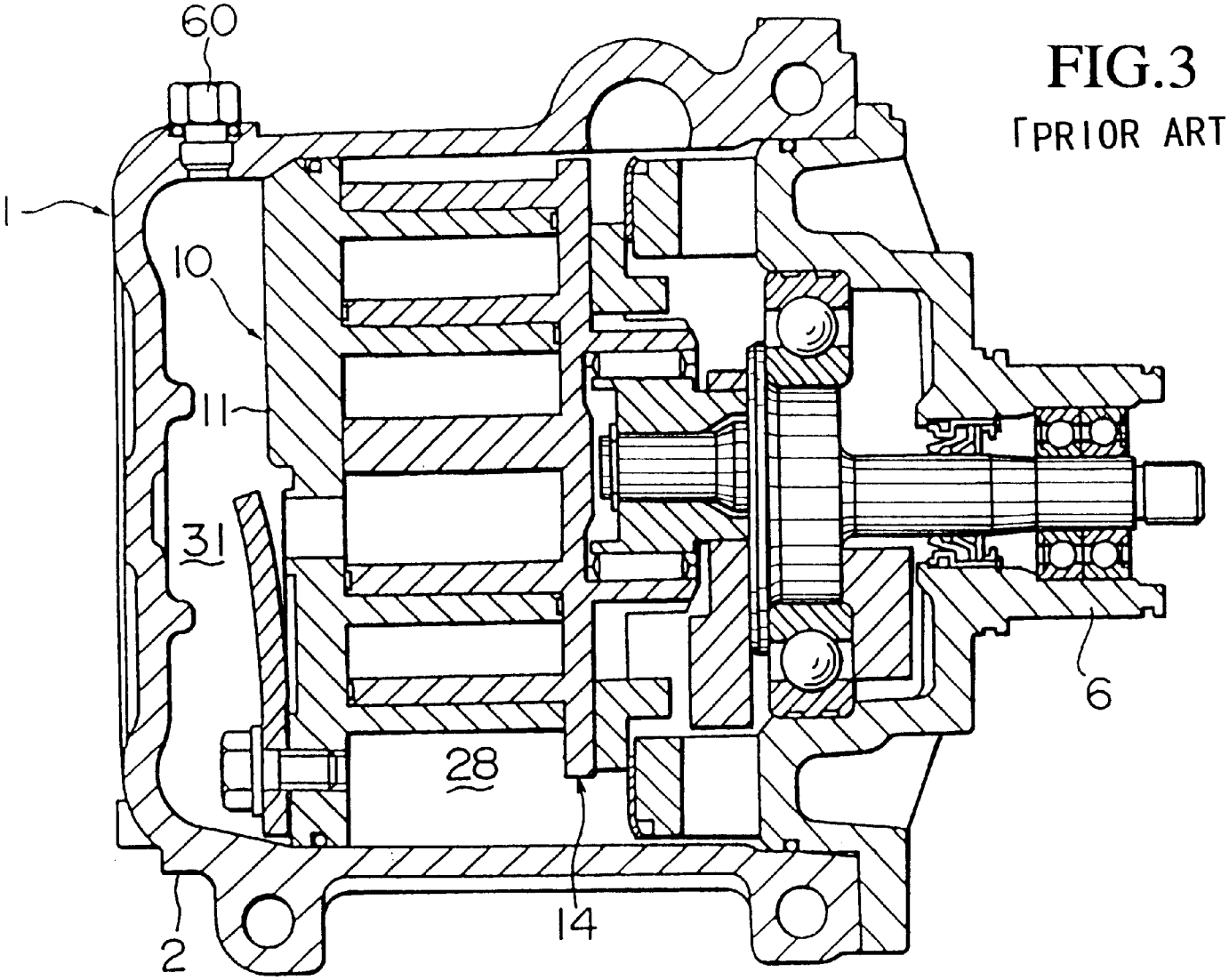
FIG.3 [PRIOR ART]
FIG. 3 is a vertical-cross section view which shows the conventional scroll compressor.

As shown in FIG. 2, the pressure relief valve 50 has the external form of a bolt, being formed with screw threading 57 on the outer perimeter of the end of its shaft 56. In addition, along its shaft, the gas path 59 which extends therethrough is formed, and its head 55 forming gas entrance 51, and the end of the shaft 56 forming the gas exit 54.

Thus, when the pressure of the refrigerant gas inside the discharge cavity 31 rises abnormally, the gas is expelled into the suction chamber 28 from the gas exit 54 by pushing open the valve 52 (in the rightward direction in the figure) to overcome the tension of the spring 53. 58 is the spring shoe and 61 is the 'O' ring.

Thus, because the pressure inside the discharge cavity 31 decreases due to the opening of the pressure relief valve 50, abrasion of the scroll wrap 12 of the fixed scroll 10 and the scroll wrap 19 of the swirling scroll 14 can be prevented.

In addition, when the pressure relief valve 50 opens, the gas inside the discharge cavity 31 is discharged into the section chamber 28, that is, inside the closed housing 1, and because it is not discharged outside the closed housing 1 as happens conventionally, it is not necessary to resupply refrigerant gas to the refrigerant circuit.

Finally, because the exhaust valve 30 and the retainer 32 are anchored to the end plate 11 of the fixed scroll 10 by the pressure relief valve 50, the bolt conventionally used to fasten the exhaust valve 30 and the retainer 32 is unnecessary, reducing the cost.

What is claimed is:

1. A scroll compressor comprising:

a closed housing;

a fixed scroll disposed in said closed housing;

a swirling scroll disposed in said closed housing, and meshing with said fixed scroll, and moving in a swirling motion;

a compression chamber formed by the meshing of said fixed scroll and said swirling scroll;

a suction chamber connected to said compression chamber;

an discharge cavity connected to said compression chamber;

a partition separating said discharge cavity from said suction chamber;

an exhaust valve provided between said compression chamber and discharge cavity;

a retainer for regulating a head of said exhaust valve; and a pressure relief valve attached to and extending through said partition, while anchoring said exhaust valve and retainer to said partition.

2. A scroll compressor according to claim 1, wherein a screw is mounted on the periphery of said relief valve and is attached to said partition.

* * * * *